US005392358A

United States Patent [19]

Driver

[11] Patent Number: 5,392,358

[45] Date of Patent: Feb. 21, 1995

[54] ELECTROLYTIC LOUDSPEAKER ASSEMBLY

[76] Inventor: Michael L. Driver, 12423 Gladstone Ave. #4, Sylmar, Calif. 91342

[21] Appl. No.: 42,572

[22] Filed: Apr. 5, 1993

[51] Int. Cl.[6] ..... H04R 19/02

[52] U.S. Cl. ..... 381/191; 381/113; 381/174

[58] Field of Search ..... 381/191, 113, 174, 203, 381/116, 169; 179/111 R; 310/324, 311

[56] References Cited

U.S. PATENT DOCUMENTS 4,160,882 7/1979 Driver ..... 381/191

5,054,081 10/1991 West ..... 381/191

*Primary Examiner*—Curtis Kuntz

*Assistant Examiner*—Sinh N. Tran

*Attorney, Agent, or Firm*—Albert O. Cota

[57] ABSTRACT

An improved electrolytic loudspeaker assembly (10) designed to reproduce a broad band of audio signals and that consists of a thin, non-magnetic capacitive transducer (12) and a transducer driver unit (60). The transducer (12) consists of a compound diaphragm (14) further consisting of a vibratory center section (16) having attached to each of its surfaces a respective front section (26) and back section (32). All three sections of the compound diaphragm are held captive by a frame assembly (40). The transducer (12) is driven and controlled by the transducer driver unit (60). The unit couples the audio signal to the transducer's front and back sections (26) (32) and supplies an unregulated, d-c bias voltage to the transducer's center section (16). The unit (60) maintains the proper ratio between the bias voltage and audio signal to achieve optimum performance.

7 Claims, 4 Drawing Sheets

ELECTROLYTIC LOUDSPEAKER ASSEMBLY

TECHNICAL FIELD

The invention pertains to the general field of loudspeakers and more particularly to an electrolytic loudspeaker assembly consisting of a relatively flat, non-magnetic, capacitive transducer that is driven and biased by an electronics transducer driver circuit.

BACKGROUND ART

Since the advent of "high fidelity" audio systems, engineers have strived to develop loudspeakers that were relatively free from distortion and with a frequency response that would allow concert hall music to be closely reproduced. Loudspeakers are broadly categorized as being either magnetic, moving coil speakers or non-magnetic, electrostatic speakers/transducers. The instant invention discloses an electrolytic speaker which is more closely related to the electrostatic types. Therefore, the reminder of the discussion pertains to only electrostatic speakers.

Most prior art electrostatic speakers generally consist of a center flexible membrane or diaphragm having on each side a fixed electrode in the form of a grid of wires. The wires are spaced apart so as to enable sound waves generated by the movement of the flexible membrane to be emitted. The wires are sheathed in a dielectric insulation material and the flexible membrane has a coating of a highly resistive material. The membrane is further suspended within an open latticed frame between the electrode wires so that when operated, relatively small segments of the diaphragm are enabled to vibrate under the influence of the electrostatic fields acting upon the diaphragm.

A search of the prior art did not disclose any patents that read directly on the claims of the instant invention however, the following U.S. patents were considered related:

| U.S. Pat. No. | INVENTOR | ISSUED |
|---|---|---|
| 4,160,882 | Driver | 10 July 1979 |
| 3,942,029 | Kawakami et al | 2 March 1976 |
| 3,705,312 | Sessler et al | 5 December 1972 |
| 3,345,469 | Rod | 3 October 1967 |

The Driver patent discloses an electrostatic transducer that has applicability as a loudspeaker. The transducer consists of two parallel diaphragms each consisting of two plastic sheets, having different charge carrying characteristics, that are sandwiched between an electrically conductive layer. The two diaphragms are separated by a centrally located perforated electrically conductive sheet and a dielectric material sandwiched between the conductive sheet and each diaphragm. The diaphragm's two electrically conductive layers are connected across the secondary winding of an audio transformer and the centered electrically conductive sheet is connected to the center tap of the transformer. Thus, when the transformer is applied an audio signal the two diaphragms are driven in a push-pull relation to reproduce the audio.

The inventor of the U.S. Pat. No. 4,160,882 is also the inventor of the instant application and pending application Ser. No. 07/949,801. The instant application differs from both the patent and the pending application in that the transducer driver unit has been redesigned and the improved electrolytic loadspeaker assembly no longer requires polarization or a bias regulator/dielectric drain circuit.

The Kawakami et al patent discloses an electrostatic transducer that can be utilized in either a speaker or microphone. The transducer consists of a vibrating plate or electret diaphragm having a monocharge of positive or negative potential on its surface. The electret diaphragm is made of a thin polymer film that is bonded to a support so that uniform tension exists. A pair of electrically conductive electrodes are brought in contact with opposite sides of the polymer films, and an electrostatic shield, such as a mesh, covers the surface of the two electrodes. A d-c voltage is time-applied across the electrodes to allow the electret to heat to its curie temperature of 120° C. The electret is subsequently cooled to produce a quasi permanent state of electric polarization.

The Sessler patent discloses a method for preparing a thin-film electret. The method includes placing a thin polymer film between two electrodes together with a dielectric plate. A voltage of about 30 keV is then applied across the resulting sandwich of elements for about one minute at room temperature and at atmospheric pressure. The method produces charge-densities which are greater by a factor of three than those previously reported.

The Rod patent discloses a loudspeaker that operates on electrostatic principles. The speaker consists of a centrally located movable diaphragm which is coated on both sides with a thin, flexible electrically conductive layer. On each side of the diaphragm is located at least one hermetically sealed plastic dielectric sheet. When air or other gas is trapped between the sheets and the diaphragm, a buffer zone is created. To each outermost dielectric sheet is attached an electrode and to the centered conductive diaphragm is likewise attached an electrode. The two buffer electrodes are connected across the secondary winding of a step-up transformer and the diaphragm electrode is connected through a d-c voltage source to the centertap of the transformer. The transformer's primary winding is connected to the diaphragm driving signal that is derived from the signal input from a conventional low-impedance amplifier.

The above described electrostatic transducers, although being superior in many respects over the moving-coil type, have received poor industry/consumer acceptance. This poor acceptance is due in part to the undue mechanical complexity of some designs, low acoustic output, the requirement for a comparatively large radiating area and a dependence upon the application of a relatively high d-c polarizing bias voltage between the flexible diaphragm and the wire grid electrodes. For example, a typical full range push-pull electrostatic speaker requires a bias voltage of 3500 volts d-c and a driving amplifier with a power capacity of from 60 to 100 watts. Additionally, the prior art electrostatic speakers are only able to reproduce adequately from the mid-range and higher audible frequencies. Therefore, a bass speaker is commonly connected to reproduce the bass frequencies.

To overcome some of the above defects, transducers utilizing electrets as the diaphragm have been employed. The electret diaphragm was thought to be permanently polarized or charged and therefore not requiring a separate polarizing d-c voltage. However, these electrets have been found to be unsatisfactory for application as loudspeakers because they decay, at least to a first approximation, according to an equation of the form dp/dt=oc P because the misalignment of the partially oriented dipoles is a random process.

For background purposes and as indicative of the art to which the invention relates, reference may be made to the following remaining patents found in the

| PATENT NO. | INVENTOR | ISSUED |
|---|---|---|
| 4,726,443 | Ugaji, et al | 23 February 1988 |
| 3,941,946 | Kawakami et al | 2 March 1976 |
| 2,037,537 (GB) | Kawasaki | 9 July 1980 |

DISCLOSURE OF THE INVENTION

The improved electrolytic loudspeaker assembly is designed to reproduce a broad band of the audible spectrum by utilizing a relatively flat, non-magnetic and non-ferrous structure. Because of its flat structure and portability, the loudspeaker can be placed or mounted in places that are unsuitable for conventional loudspeakers. The flattened design also allows the structure to be bent or curved which further extends its mounting capabilities in locations such as a curved corner or to items such as a lamp shade. Additionally, because of its inherent low weight, the loudspeaker is ideal for use in weight-critical environments such as in aircraft and spacecraft. Another physical aspect of some importance is that if the structure is accidently pierced the audio output continues. This feature is especially important when the loudspeaker assembly is used in military bases, vehicles, aircraft and spacecraft.

The electrolytic loudspeaker assembly consists of two major elements: a capacitive transducer and a transducer driver unit. In electrical terms, the capacitive transducer resembles a pair of double-anode diodes connected in series or a unijunction transistor. The center plates are attached to form a center section that is connected to a single center electrode and the two outer plates are connected respectively to a front and back electrode.

In its basic design configuration, the electrolytic loudspeaker assembly consists of:

A. a capacitive transducer having a compound diaphragm consisting of:
   a) a center section having a first surface and a second surface and having attached to one end a center electrode,
   b) a front section in contact with the first surface of the center section and having attached to one end a front electrode,
   c) a back section in contact with the second surface of the center section and having attached to one end a back electrode,
   d) a frame assembly having means for suspending the compound diaphragm, and
   e) a transducer driver unit having means for:
      1. interfacing with the compound diaphragm,
      2. supplying a bias voltage to the center electrode,
      3. providing an alternating signal, analogous to the audio signal, that is applied across the front and back electrodes to allow the compound diaphragm to be driven in a push-pull relation.

The invention is disclosed in terms of two designs for the compound diaphragm. In the first design, the center section, which functions as the primary vibratory element, includes a first and second metallized film that after attachment to the frame are heat shrunk to provide the proper tension. The two films are in intimate contact, separated only by a thin coating of a petroleum gel or the like that serves to provide proper damping. The front and back sections are each comprised of a grided dielectric spacer each having in intimate contact on their outer surface an aluminum perforated grid. Each of the front and back sections have an area that is less than 75 percent of the center section area and are attached to the center section with the metal grids facing outwardly.

In the second design, the center section includes a center metal grid that has attached to each surface a dieletric spacer and includes a center electrode. Attached to each side of the center section in intimate contact, is a metallized film that has its metallized surface facing outwardly. To each metallized surface is attached respectively a front electrode and a second electrode. The compound diaphragm is then attached to a frame assembly and heat shrunk to provide the proper tension.

The compound diaphragm is driven and controlled by the transducer driver unit. This unit couples the incoming audio signal to a front and back electrode that are respectively attached to the front and back sections, provides an unregulated d-c bias voltage to the center electrode of the center section and maintains the ratio of the bias voltage and audio signal at the proper ratio to achieve optimum performance.

In view of the above disclosure, it is the primary object of the invention to provide an improved electrolytic loudspeaker assembly that with a small physical volume reproduces an audio signal over a wide frequency range. It is also an object of the invention to provide an electrolytic loudspeaker assembly that:

- is cost effective from both a consumer and manufactures point of view,
- is highly reliable and easily maintained,
- can be designed to fit a particular space requirement,
- does not require the high signal and bias voltages needed to operate electrostatic loudspeakers,
- can be mounted in various positions and locations that are not possible with current magnetic moving-coil speakers and electrostatic speakers,
- does not require that the completed assembly be subjected to a polarization and discharge cycle, and
- is portable since an external a-c voltage source is not required to provide the bias voltage.

These and other objects and advantages of the present invention will become apparent from the subsequent detailed description of the preferred embodiment and the claims taken in conjunction with the accompanying drawings.

BRIEF DESCRIPTION OF THE DRAWINGS

FIG. 6 is a schematic diagram of the transducer driver unit.

BEST MODE FOR CARRYING OUT THE INVENTION

Figure 1:
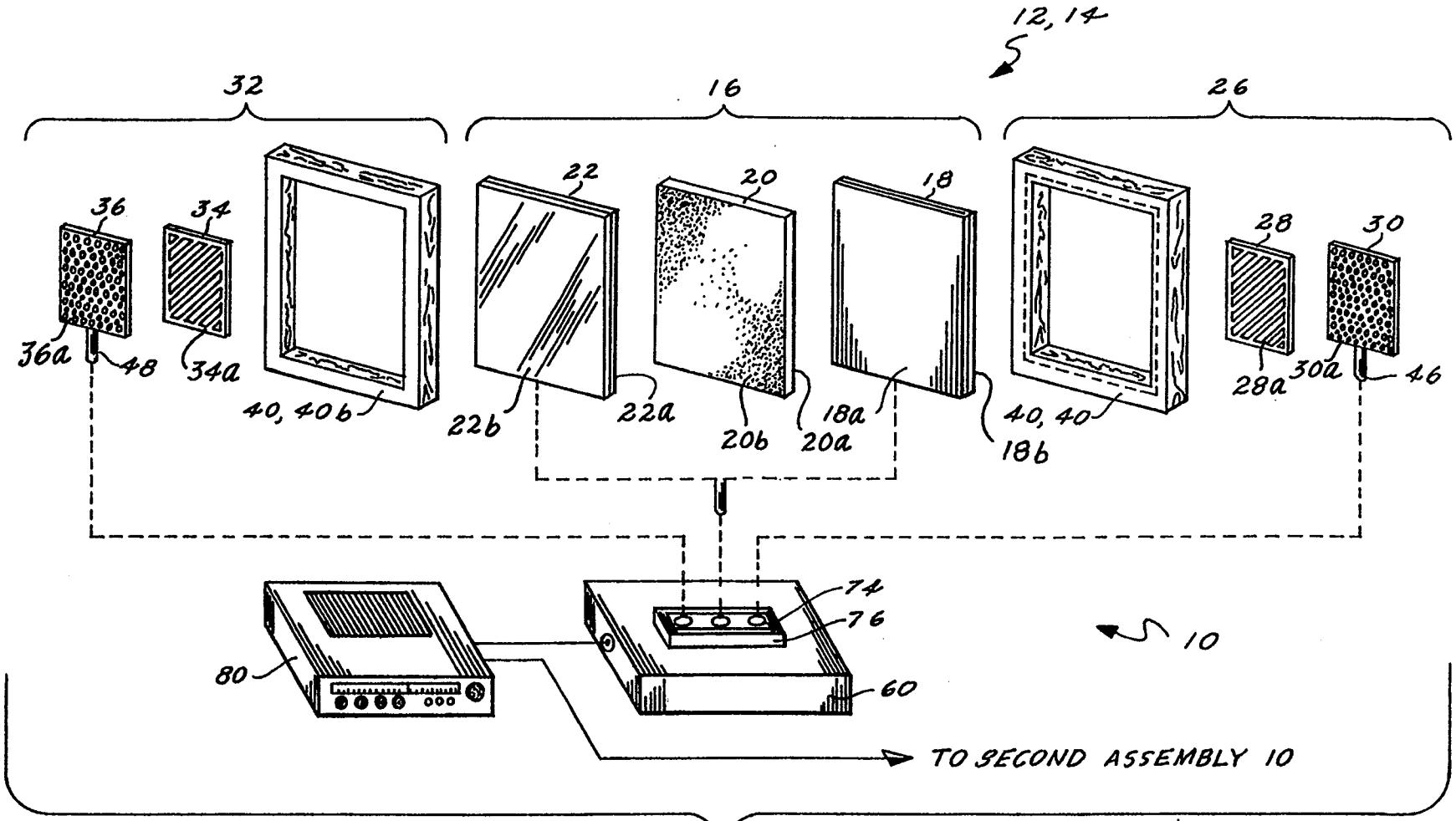
FIG. 1 is an exploded view of the electrolytic loudspeaker assembly of a first design showing the attachment of the capacitive transducer to the transducer drive unit which is connected to an audio source.

The best mode for carrying out the invention is presented in terms of a preferred embodiment that is packaged in a thin, easily mounted portable structure that is designed to reproduce audio signals over a wide frequency range.

In its basic configuration, the improved electrolytic loudspeaker assembly 10 as shown in FIGS. 1–6 is comprises of two major elements: a capacitive transducer 12 and a transducer driver unit 60. The transducer 12 is further comprised of a compound diaphragm 14 consisting of a center section 16, a front section 26, a back section 32 and a frame assembly 40. The compound diaphragm 14 is described in terms of two designs.

The first design as shown in FIGS. 1–4, consists of a center section 16 which includes four elements: a first metallized film 18 having a metallized surface **18*a* that faces inwardly, a thin flexible barrier 20 having a first side 20*a* and a second side 20*b*, where the first side 20*a* is sized to cover the metallized surface 18*a*, a second metallized film 22 having a metallized surface 22*a* that faces inwardly and sized to cover and be in intimate contact with the second side 20*b* of the flexible barrier 20, and a means for making an electrical contact which preferably consists of a center electrode 44 that is attached to one end of the composite center section 16**.

Figure 2:
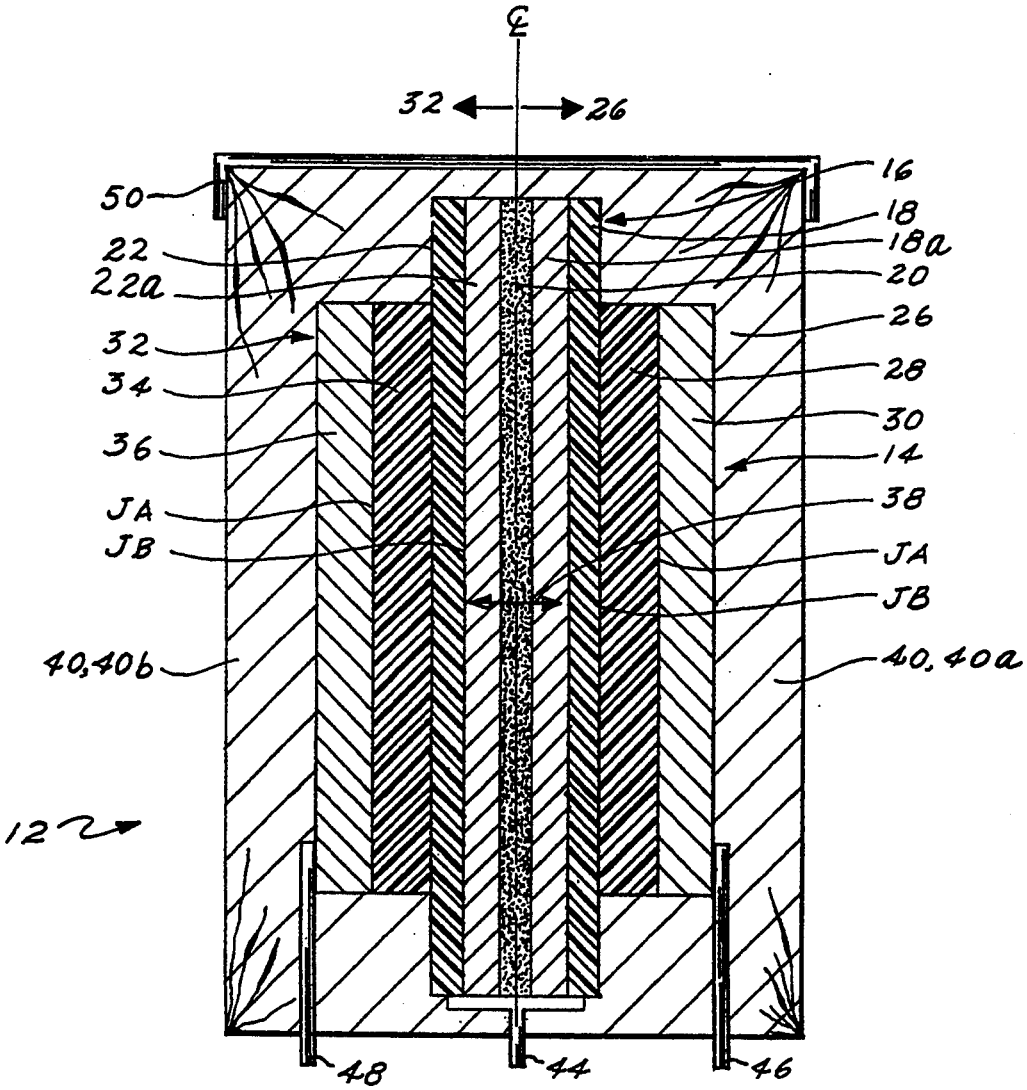
FIG. 2 is a sectional view of the capacitive transducer.
Figure 3:
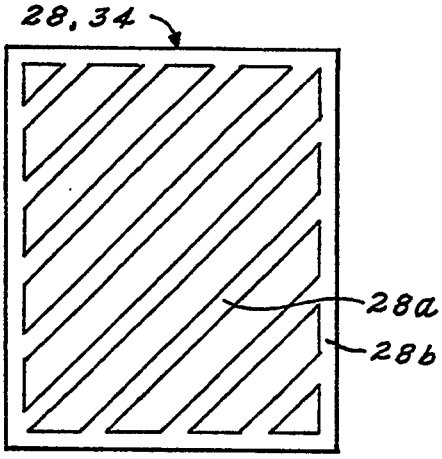
FIG. 3 is a front plane view of the first or second dielectric spacer.
Figure 4:
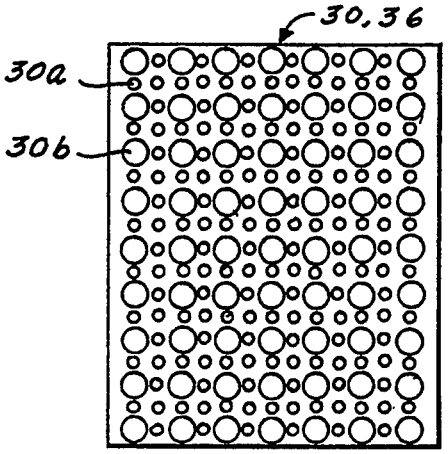
FIG. 4 is a front plane view of the first or second metal grid.

The front section 26 as shown in FIGS. 1 and 2, consists of a first dielectric spacer 28 having a grid pattern **28*a* as best shown in FIG. 3. The spacer has an area that is less than the area of the center section 16 and is in intimate contact with the non-metallic surface of the first metallized film 18. In intimate contact with the opposite surface of the spacer 28 is a first metal grid 30 that preferably is made of aluminum. This grid as best shown in FIG. 4, has a multiplicity of perforations 30*a*, is sized to cover the spacer 28 and has a means for making an electrical contact which preferably consists of a front electrode 46 attached to one of its ends as shown in FIG. 1**.

The back section 32 is similarly constructed and sized as described above for the first section 26. The back section consists of a second dielectric spacer 34 having a grid pattern **34*a*, a second metal grid 36 having perforations 36*a* and a means for making an electrical contact which preferably consists of a back electrode 48 as shown in FIG. 1**.

The frame assembly 40 as shown in FIGS. 1 and 2 provides the means by which the compound diaphragm 14 is held in a suspended configuration. The frame 40 includes a front section **40*a* and a back section 40*b*. The front section 40*a* has attached to its inward side the outward edges of the non-metallized surface of the first metallized film 18. The back section 40*b* has attached to its inward side the outward edges of the non-metallized surface of the second metallized film 22. The two inward frame surfaces are brought together in alignment and are then attached by an attachment means to form the compound diaphragm 14**. The frame can be made of any material. However, if a metal is used, aluminum is preferred to avoid any possible interaction with a dissimilar metal.

The transducer driver unit 60, which is described in detail infra, has the means to interface with the compound diaphragm, to supply a positive, unregulated d-c bias voltage that is applied to the center electrode 44, and to produce an alternating signal that is analogous to the audio signal. The alternating signal is applied across the front and back electrodes 46,48 to allow the compound transducer 12 to be driven in a push-pull relation.

In its preferred embodiment, the first and second metallized films 18,22 are made by evaporating or depositing a thin metal layer, such as aluminum having a thickness of between 1.8 to 2.2 microns, onto a thin, grain-oriented polymer material such as polyethylene terephthalate (PET). The metallized films, which are also known by the tradename MYLAR or KODAR, are heat shrinkable. Thus, after each film is attached to the frame assembly 40 by an adhesive it is heated so that it is stretched taut allowing the films to oscillate back and forth in the direction of the arrows 38 as shown in FIG. 2. The heating may be accomplished by a heating means that includes a heat gun or other heat sources.

As best shown in FIGS. 1 and 2, the two films 18,22 are separated by a thin flexible barrier 20 that may consist of a thin rubber sheet but preferably consists of a petroleum gel such as known commercially by its tradename VASELINE. After a thin layer of the gel 20 is spread evenly over the metallized surface **18*a*, the metallized surface 22*a* of the second film 22 is placed over the gel to form the center section. The gel functions as a non-drying adhesive and serves to dampen and maintain the structural integrity of the center section 16**. To operate within its design parameters, the center section may vary in thickness from 0.001 to 0.03 inches (0.025 to 0.762 mm).

The primary parameters that control the frequency response of the transducer 12 are the tautness, length and mass (thickness) of the first and second metallized foils 18,22 and the frame assembly 40. Thus, by selectively controlling these parameters, a transducer 12 can designed and produced to accommodate a particular frequency response required for a specific application.

The front and back sections 26,32 consist of the first and second dielectric spacers 28,34 as shown in FIGS. 1 and 3 and the first and second metal plates 30,36 as shown in FIGS. 1 and 4. In the first design, the dielectric spacers have an area, as measured from its width and length that is less than 75 percent of the area of the center section 16. The spacers may have a thickness between 0.001 to 0.009 inches (0.025 to 0.229 mm), can be made of any lightweight non-conductive material and have a grid pattern to create individual areas for vibration. The grid pattern can take any form. However, a grid pattern consisting of thin angular sections **28*a* interposed within a perimeter border section 28*b* as shown in FIG. 3**, was found to be very satisfactory.

The metal grids 30,36 in the first design are dimensioned to allow them to be attached, by an attachment means such as an adhesive, directly over and in intimate contact with the outer surface of the respective dielectric spacers 28,34. The plates are preferably made of aluminum having a thickness of between 18 to 26 gauge and have a perforation pattern. In the preferred embodiment the perforations consist of a multiplicity of ordered first bores **30*a* and second bores 30*b* where the second bores have a larger diameter than the first bores as best shown in FIG. 4**.

The compound diaphragm 14 is designed to be suspended within the frame assembly 40 as shown in FIGS. 1 and 2. The frame assembly consists of two sections, a front section **40*a* and back section 40*b***. Attached, by an adhesive, to the inward side of the frame's front section 40*a* are the outward edges of the non-metallized surface of the first metallized film 18. Likewise, the outward edges of the non-metallized surface of the second metallized film 22 are attached to the inward side of the frame's back section 40*b*. After the metallized films 18,22 are attached, they are heat shrunk to produce the required tension and the two inward frame sections are brought together in alignment and attached by an attachment means 50. The attachment means 50 may consist of a tape that is folded over the edges of the perimeter of the frame assembly 40 or any other type of clamping structure. The petroleum gel 20 holding the two metallized films 18,22 also aids in maintaining the two frame sections together adding to the structural integrity of the capacitive transducer 12.

Figure 5:
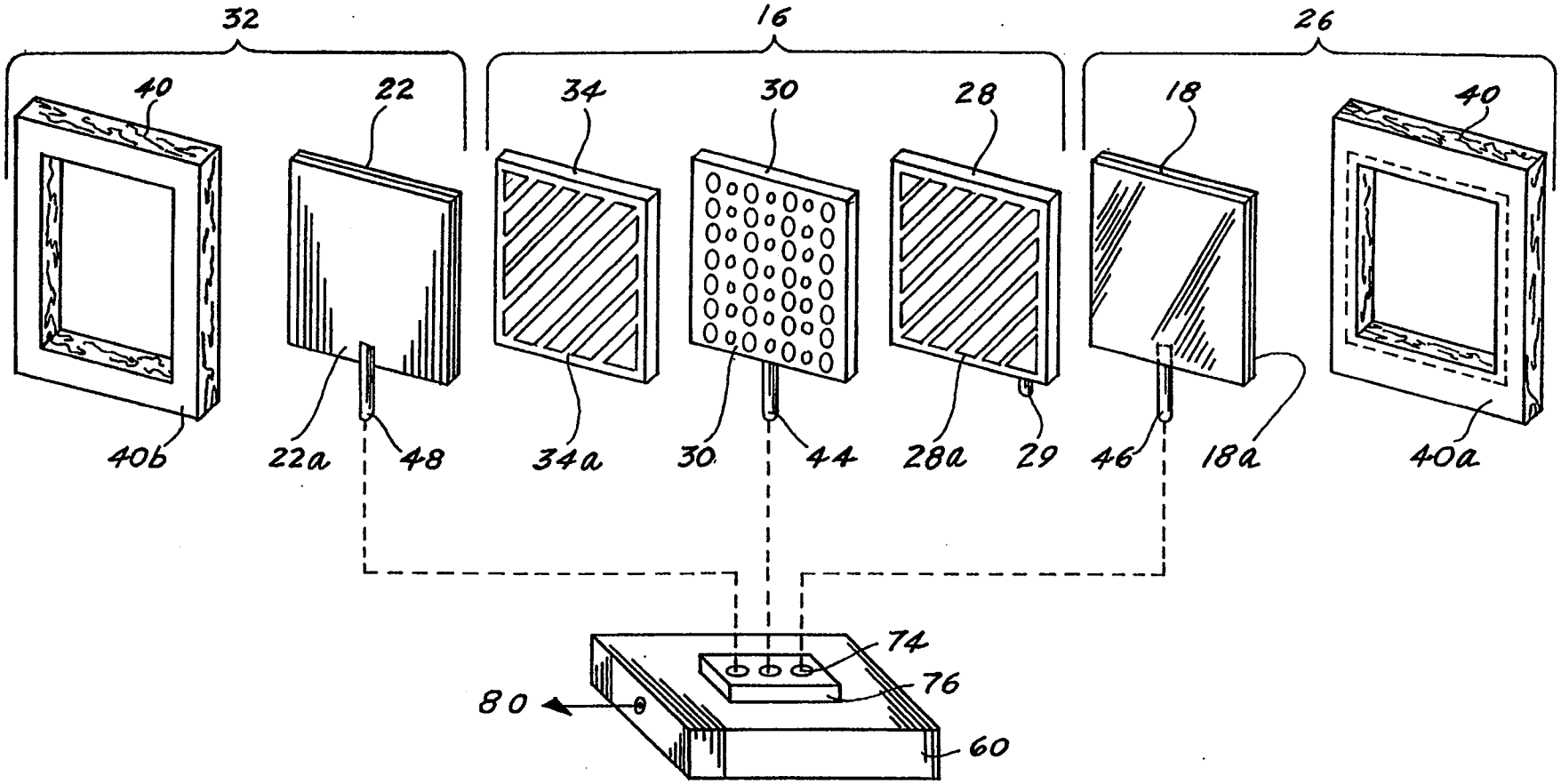
FIG. 5 is an exploded view of the electrolytic loudspeaker assembly of the second design.
Figure 5:
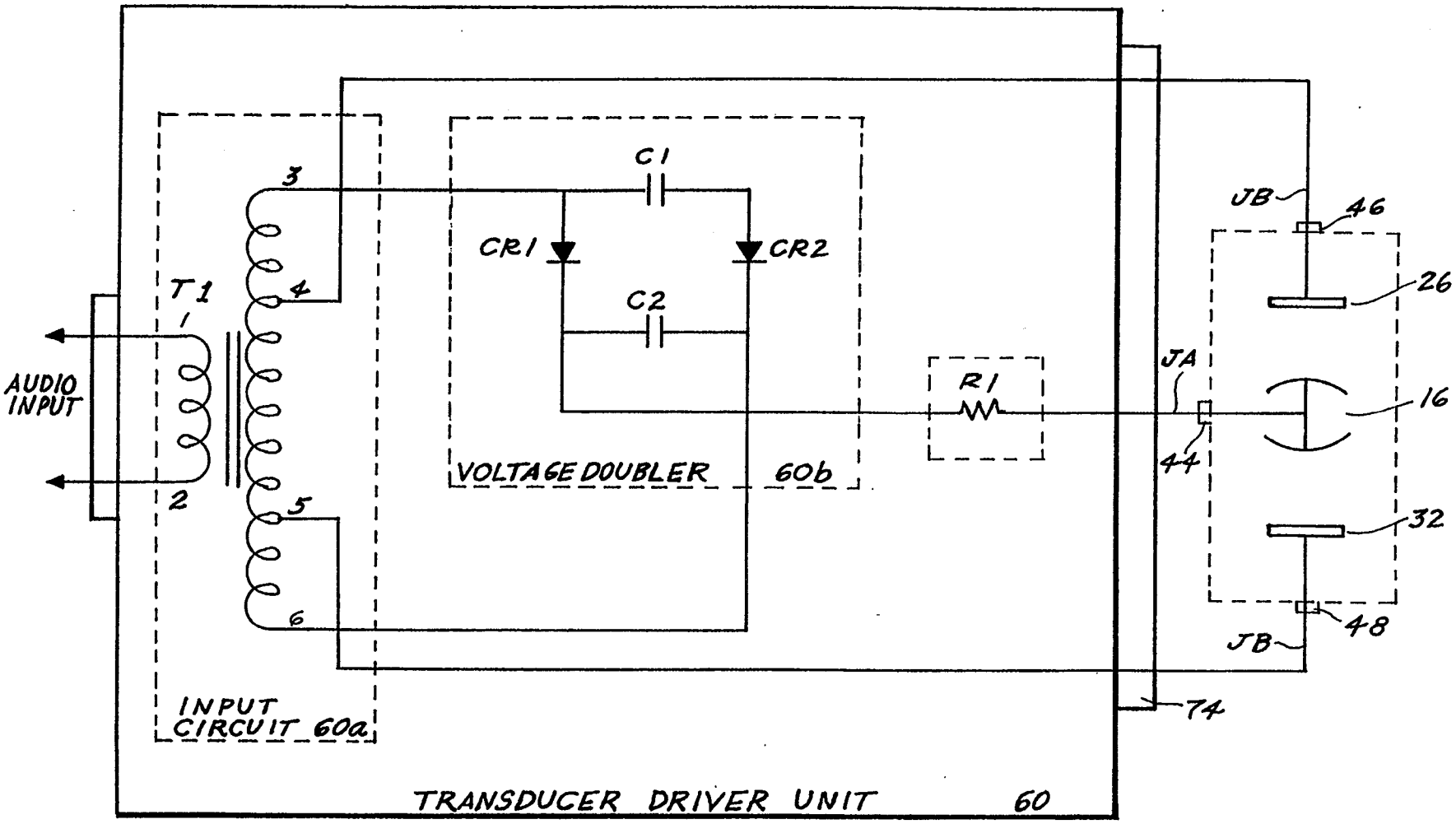

The second design of the compound diaphragm 14 as shown in FIGS. 3, 4 and 5, also consists of a center section 16, a front section 26 and a back section 32. The center section 16 includes three elements: a center metal grid 30 having a first surface, a second surface and a center electrode 44 that is attached to one end, a first dielectric spacer 28 having an inward side and an outward side, where the inward side is attached to the first surface of the center metal grid 30, and a second dielectric spacer 34 having an inward side and an outward side, where the inward side is attached to the second surface of the center metal grid.

The front section 26 includes two elements: a first metallized film 18 that is attached to the outer side of the first dielectric spacer 28. The metallized surface 18*a* which faces outwardly has attached to one end a front electrode 46. The edges of the outward facing metallized surfaces 18*a* are also attached to the inward side of the front section 40*a* of the frame assembly 40.

The back section 32 also includes two elements: a second metallized film 22 that is attached to the outer side of the second dielectric spacer 34. The metallized surface 22*a* which faces outwardly has attached to one end a second electrode 48. The edges of the outward facing metallized surface 22*a* are also attached to the inward side of the back section 40*b* of the frame assembly 40.

The individual elements that comprise the second design of the compound diaphragm function as described for the first design. Therefore, no further description is needed. The major difference between the two designs is the placement within the diaphragm of the elements, the identical dimension of the elements used in the second design, and the addition of an air vent 29 located on one side of the first or second dielectric spacers 28,34. The vent 29 provides equalization of the outside air pressure to any air that may be captured within the compound diaphragm 14. Thus insuring the uninterrupted operation of the assembly 10 at various altitudes.

The second major element of the electrolytic loudspeaker assembly 10 is the transducer driver unit 60 which is applicable to both the first and second designs of the compound diaphragm 14. This unit as shown in block form in FIG. 1 and schematically in FIG. 6, is preferably designed to directly interface with the capacitive transducer 12 by a combination of an attachment structure 76 and the output connector 74 which accepts the transducers center electrode 44, front electrode 46 and back electrode 48. In lieu of the connector, the electrode leads may be directly soldered to the respective leads on the driver unit 60.

The unit 60 functions to couple the incoming audio signal from an audio source 80 to the front and back sections of the capacitive transducer via the front or back electrodes 46,48, and supplies an unregulated, forward d-c bias voltage to the transducer's center section via the center electrode 44. To provide the above functions, the driver unit 60 is comprised of an input circuit 60*a* consisting of an audio input-matching transformer T1 that operates a voltage doubler circuit 60*b* consisting of diodes CR1 and CR2 and capacitors C1 and C2. In the preferred circuit, both diodes are type ECC118-3 KV focus diodes manufactured by the Sylvania Corporation and both capacitors are ceramic, have a capacitance of 0.001 mfd, a working voltage of 3 KV and are manufactured by the Spraque Corporation. The laboratory transformer T1, was manufactured to the following specifications:

Laminations: EI625 (0.014 HI Silicon)
Bobbins: KET 62
Primary Winding: 24 gauge single nylese wire, 80 turns
Secondary Windings: 30 gauge heavy nylese wire tap's 3-4 and 5-6 each have 1400 turns; tap 4-5 has 2800 turns
Overall Turns Ratio: 70:1

To optimize the transformer design for a particular frequency response, the capacitive reactance ($X_c$) and ultimately the impedance (Z) of the assembly 10 is calculated. The transformer T1 is then wound to match this impedance.

The relatively high impedance of the capacitive transducer 12 dictates that it be driven by a transformer. Therefore, the input circuit 62 consists of the audio input-matching transformer T1 that has a secondary-to-primary turns ratio of 70:1. The transformer's primary winding labeled 1 and 2 is connected through input connector 72 to the audio signal which is derived from the output of an audio source 80 such as the radio receiver as shown in FIG. 1. The transformer's secondary windings consists of three windings labeled 3-4 4-5, and 5-6 as shown in FIG. 5. The audio windings which are connected to taps 4 and 5 have a turns ratio of 35:1 and supply the audio drive or analogous audio signal through an output connector 74 to the front and back electrodes 46,48. The bias windings 3 and 6 which have a turns ratio of 70:1 are connected to the doubler circuit 60*b* which provides an output that is approximately two-times the peak value of its input voltage. This stepped-up voltage is rectified to produce a forward d-c bias voltage that is applied from the junction of diode CR1 and capacitor C2 to the center electrode 44 which is connected to the assemblies center section 16.

Typically, the input audio signal from the audio source 80 is 1 volt a-c. The transformer T1 steps this voltage up to 70 volts a-c which is then doubled and rectified by the doubler circuit 60*b* to produce a forward bias voltage of 140 volts d-c. The bias voltage is then applied to the transducer's center electrode 44 via the output connector 74. The magnitude of the bias voltage is dependent upon the level of the incoming audio signal. However, in all cases, the bias voltage is maintained at an optimal level since it is dependent upon the selected turns ratio of the input to secondary windings of the transformer T1. With this arrangement, the transducer driver circuit 60 is able to maintain a bias on the vibrating transducer, which at all times, is at least two times the magnitude of the received audio signal. The combination of the input signal and bias voltage allows the diaphragm to operate under the basic laws of magnetism which causes the diaphragm to vibrate in a controlled manner. Also, because the driver circuit 60 supplies the bias voltage, the assembly is portable. In current electrostatic speakers the bias voltage is supplied by a separate power supply that is connected to the utility a-c voltage source.

As shown in FIG. 5, an optional resistor R1 can be included at the output of the doubler circuit 60B. The value of this resistor is selected to optimize the bias voltage level. A fixed resistor is preferred however, a variable resistor (not shown) can also be used. The value of this resistor can be between 45 and 250 megohms; the smaller the transducer, the larger the resistance value. The optimum value is ultimately determined by the overall physical size and the biasing requirements of the completed assembly 10.

As previously described, the first and second dielectric spacers 28,34 are in intimate contact with the respective first and second metal plates 30,36 which forms an electrical junction JA. Also, the intrinsic contact between the dielectric layer and the metallized surface 18*a*, 22*a* of the first and second metallized films 18,22 form an electrical junction JB. Both these junctions as shown in FIGS. 2 and 5, function as high impedance diodes. When the audio signal is received, most of the electrons function as magnets to cause the compound diaphragm 14 to vibrate at a frequency that corresponds to the frequency of the audio signal. The surplus electrons that do not contribute to the vibrating action are simply rectified and dissipated at the JA and JB junctions.

The suspension and mounting scheme of the center section 16 and the front and back sections 26,32 of the compound diaphragm 14 provide a substantial mechanical advantage that allows the capacitive transducer 12 to operate at an extended frequency range.

In this mounting scheme, the front and back sections 26,32 contribute to the degree of oscillating distance that the center section 16 can travel but the width and grid design of the first and second spacers 28,34 and the first and second metal plates 30,36 divides the center section 16 into smaller segments. The frequency response characteristics of these smaller segments become a function of the mass and length of the smaller section. Note that in all cases, the tension of the compound diaphragm 14 remains constant. If the area of each first and second metal plates 30,36 does not exceed 75 percent of the area of the diaphragm's center section 16, the acoustic output over the total area of the center section will contain usable audio information. This information will be responsive down to the fundamental mechanical resonant frequency of the center section due to the strength of the driving forces.

A calculation performed on the capacitive transducer 12 has determined that electrostatic units (ESU) converted into magnetic equivalents provide approximately 18,000 gauss of flux density. This is the equivalent of a magnetic assembly weighing approximately 10 lbs (4.5 Kg).

The design of the capacitive transducer 12 allows the design of a loudspeaker to be related to the laws of physics, which govern the vibration of strings and columns of air by application of the following formula:

$$F = 1/2L\sqrt{T/M}$$

where:

F=Fundamental mechanical resonant frequency
L=Length
T=Constant Tension
M=Mass

The primary design configuration of the capacitive transducer 12 provides wide performance characteristics. However, from the above formula, it can be seen that by varying the mass and length, a capacitive transducer that operates on a different section of the audible spectrum can be designed. In a practical sense, the operating parameters of the transducer can be tailored by design in about the same manner as one would build and tune a piano.

Once a physical size and shape for a capacitive transducer 12 has been determined, whether it be for a loudspeaker or earphones, the front and back sections 26,32 are sized to cover an area that is less than 75 percent of the area of the center section 16. The capacitance of the capacitive transducer 12 is then measured or calculated. The capacitive reactance is calculated to match the center of the band of frequencies the transducer is to reproduce. Once the capacitive reactance is expressed in ohms, the input transformer T1 can be wound to match the required band pass. No additional design changes are necessary in the remaining components of the transducer driver circuit 60.

While the invention has been described in complete detail and pictorially shown in the accompanying drawings, it is not to be limited to such details, since many changes and modifications may be made in the invention without departing from the spirit and the scope thereof. For example, a curved capacitive transducer 12 can be easily designed and manufactured. Hence, it is described to cover any and all modifications and forms which may come within the language and scope of the claims.

I claim:

1. An electrolytic loudspeaker assembly comprising:
   A. a capacitive transducer consisting of a compound diaphragm, where said compound diaphragm comprises:
      a. a center section having an area comprising:
         (1) a first metallized film having a metallized surface that faces inwardly and a non-metallized surface that faces outwardly,
         (2) a thin flexible barrier having a first surface and a second surface. where the first surface is sized to cover the metallized surface of said first metallized film,
         (3) a second metallized film having a metallized surface that faces inwardly and a non-metallized surface that faces outwardly, where the metallized surface is sized to cover and be in intimate contact with the second surface of said thin flexible barrier,
         (4) means for making an electrical contact with said center section comprising a center electrode
      b. a front section comprising:
         (1) a first dielectric spacer having a grid pattern and an area that is less than the area of said center section and where said first dielectric spacer is in intimate contact with the non metallized surface of said first metallized film,
         (2) a first metal grid having a multiplicity of perforations, and is sized to cover and be in intimate contact with said first dielectric spacer, (3) a means for making an electrical contact with said first metal grid comprising a front electrode, c. a back section comprising:

(1) a second dielectric spacer having a grid pattern and an area that is less than the area of said center section and where said second dielectric spacer is in intimate contact with the non-metallized surface of said second metallized film, (2) a second metal grid having a multiplicity of perforations, and that is sized to cover and be in intimate contact with said second dielectric spacer, (3) means for making an electrical contact with said second metal grid comprising a back electrode.

d. a frame assembly having means for suspending said compound diaphragm, and

B. a transducer driver unit having means for:

a. interfacing with said compound diaphragm, b. supplying a bias voltage to said center electrode, and c. providing an alternating signal, analogous to an audio signal, across said front and back electrodes to allow said compound diaphragm to be driven in a push-pull relation.

2. An electrolytic loudspeaker assembly comprising:

A. a capacitive transducer having a compound diaphragm where said compound diaphragm comprises a. a center section having an area comprising:

(1) a first metallized film having a metallized surface that faces inwardly and a non-metallized surface that faces outwardly, (2) a flexible barrier comprised of a thin layer of petroleum gel that is spread evenly over the metallized surface of said first metallized film, (3) a second metallized film having a metallized surface that faces inwardly and a non-metallized surface that faces outwardly where the metallized surface of said second metallized film is placed over the gel to form said center section, (4) means for making an electrical contact with said center section comprising a center electrode b. a front section comprising;

(1) a first dielectric spacer having a grid pattern and an area that is less than the area of said center section and where said first dielectric spacer is in intimate contact with the non-metallized surface of said first metallized film, (2) a first metal grid having a multiplicity of perforations, and is sized to cover and be in intimate contact with said first dielectric spacer.

(3) a means for making an electrical contact with said first metal grid comprising a front electrode c. a back section comprising:

(1) a second dielectric spacer having a grid pattern and an area that is less than the area of said center section and where said second dielectric spacer is in intimate contact with the non-metallized surface of said second metallized film, (2) a second metal grid having a multiplicity of perforations, and is sized to cover and be in intimate contact with said second dielectric spacer, (3) means for making an electrical contact with said second metal grid comprising a back electrode d. a frame assembly having means for suspending said compound diaphragm, and B. a transducer driver unit having means for:

a. interfacing with said compound diaphragm, b. supplying a bias voltage to the center electrode, and c. providing an alternating signal, analogous to an audio signal, across said front and back electrodes to allow said compound diaphragm to be driven in a push-pull relation, 3. An electrolytic loudspeaker assembly comprising:

A. a capacitive transducer having a compound diaphragm where said compound diaphragm comprises a. a center section having an area comprising:

(1) a first metallized film having a metallized surface that faces inwardly and a non-metallized surface that faces outwardly, (2) a thin flexible barrier having a first surface and a second surface, where the first surface is sized to cover the metallized surface of said first metallized film, (3) a second metallized film having a metallized surface that faces inwardly and a non-metallized surface that faces outwardly where the metallized surface of said second metallized film is sized to cover and be in intimate contact with the second surface of said thin flexible barrier, (4) means for making an electrical contact with said center section comprising a center electrode b. a front section comprising:

(1) a first dielectric spacer having a grid pattern and an area that is less than the area of said center section and where said first dielectric spacer is in intimate contact with the non-metallized surface of said first metallized film.

(2) a first metal grid having a multiplicity of perforations, and is sized to cover and be in intimate contact with said first dielectric spacer, (3) a means for making an electrical contact with said first metal grid comprising a front electrode, c. a back section comprising:

(1) a second dielectric spacer having a grid pattern and an area that is less than the area of said center section and where said second dielectric spacer is in intimate contact with the non-metallized surface of said second metallized film, (2) a second metal grid having a multiplicity of perforations, and is sized to cover and be in intimate contact with said second dielectric spacer, (3) means for making an electrical contact with said second metal grid comprising a back electrode, d. a frame assembly having a front section having an inward side to which is attached edges of the non-metallized surface of said first metallized film and a back section having an inward side to which is attached edges of the non-metallized surface of said second metallized film, where the two inward sides are brought together in alignment and attached by an attachment means to hold said compound diaphragm in suspension, wherein after the metallized films are attached to the respective sections of said frame assembly heat is applied over the metallized films to cause the metallized films to become taut, and B. a transducer driver unit having means for:

a. interfacing with said compound diaphragm, b. supplying a bias voltage to the center electrode, and c. providing an alternating signal, analogous to an audio signal, across said front and back electrodes to allow said compound diaphragm to be driven in a push-pull relation.

4. An electrolytic loudspeaker assembly comprising:

A. a capacitive transducer having a compound diaphragm, where said compound diaphragm comprises:

a. a center section having an area comprising:

(1) a first metallized film having a metallized surface that faces inwardly and a non-metallized surface that faces outwardly, (2) a thin flexible barrier having a first surface and a second surface, where the first surface is sized to cover the metallized surface of said first metallized film, (3) a second metallized film having a metallized surface that faces inwardly and a non-metallized surface that faces outwardly where the metallized surface of said second metallized film is sized to cover and be in intimate contact with the second surface of said thin flexible barrier, (4) means for making an electrical contact with said center section comprising a center electrode, b. a front section comprising:

(1) a first dielectric spacer having a grid pattern and an area that is less than the area of said center section and where said first dielectric spacer is in intimate contact with the non-metallized surface of said first metallized film, (2) a first metal grid having a multiplicity of perforations, and is sized to cover and be in intimate contact with said first dielectric spacer, (3) a means for making an electrical contact with said first metal grid comprising a front electrode c. a back section comprising:

(1) a second dielectric spacer having a grid pattern and an area that is less than of said center section and where said second dielectric spacer is in intimate contact with the non-metallized surface of said second metallized film, (2) a second metal grid having a multiplicity of perforations, and is sized to cover and be in intimate contact with said second dielectric spacer, (3) means for making an electrical contact with said second metal grid comprising a back electrode, d. a frame assembly having means for suspending said compound diaphragm, and B. a transducer driver comprises:

a. an input circuit consisting of an audio transformer having a primary winding connected to an incoming audio signal and multiple secondary windings that include an audio winding that supplies a signal analogous to the incoming audio signal to the front and back electrodes located respectively on said first and second metal grids, and a bias winding and, b. a doubler circuit connected across the bias winding of said transformer, where said doubler circuit has an output that produces an unregulated, forward d-c bias voltage that is applied to the center electrode located on the center section of said compound diaphragm.

5. An electrolytic loudspeaker assembly comprising:

A. a capacitive transducer having a compound diaphragm, where said compound diaphragm comprises:

a. a center section having an area comprising:

(1) a first metallized film having a metallized surface that faces inwardly and a non-metallized surface that faces outwardly, (2) a thin flexible barrier having a first surface and a second surface, where the first surface is sized to cover the metallized surface of said first metallized film, (3) a second metallized film having a metallized surface that faces inwardly and a non-metallized surface that faces outwardly where the metallized surface of said second metallized film is sized to cover and be in intimate contact with the second surface of said thin flexible barrier, (4) means for making an electrical contact with said center section comprising a center electrode, b. a front section comprising:

(1) a first dielectric spacer having a grid pattern and an area that is less than the area of said center section and where said first dielectric spacer is in intimate contact with the non-metallized surface of said first metallized film, (2) a first metal grid having a multiplicity of perforations, and is sized to cover and be in intimate contact with said first dielectric spacer, (3) a means for making an electrical contact with said first metal grid comprising a front electrode, c. a back section comprising:

(1) a second dielectric spacer having a grid pattern and an area that is less than the area of said center section and where said second dielectric spacer is in intimate contact with the non-metallized surface of said second metallized film, (2) a second metal grid having a multiplicity of perforations, and is sized to cover and be in intimate contact with said second dielectric spacer, (3) means for making an electrical contact with said second metal grid comprising a back electrode, d. a frame assembly having means for suspending said compound diaphragm, wherein said capacitive transducer can be designed to operate at selected areas of the audible spectrum by application of the following equation:

$$F = 1/2L\sqrt{T/M}$$

where:

F=Fundamental mechanical resonant frequency of the vibration of said compound diaphragm, L=Length of said compound diaphragm, T=Constant Tension of the stretch of said compound diaphragm, M=Mass of said compound diaphragm, and B. a transducer driver unit having means for:

a. interfacing with said compound diaphragm, b. supplying a bias voltage to the center electrode, and c. providing an alternating signal, analogous to an audio signal, across said front and back electrodes to allow said compound diaphragm to be driven in a push-pull relation.

6. An electrolytic loudspeaker assembly designed to be, portable and comprising:

A. a capacitive transducer having a compound diaphragm, where said compound diaphragm comprises:

a. a center section having an area comprising:

(1) a first metallized film having a metallized surface that faces inwardly and a non-metallized surface that faces outwardly, (2) a thin flexible barrier having a first surface and a second surface, where the first surface is sized to cover the metallized surface of said first metallized film, (3) a second metallized film having a metallized surface that faces inwardly and a non-metallized surface that faces outwardly where the metallized surface of said second metallized film is sized to cover and be in intimate contact with the second surface of said thin flexible barrier.

(4) means for making an electrical contact with said center section comprising a center electrode, b. a front section comprising:

(1) a first dielectric spacer having a grid pattern and an area that is less than the area of said center section and where said first dielectric spacer is in intimate contact with the non-metallized surface of said first metallized film, (2) a first metal grid having a multiplicity of perforations, and is sized to cover and be in intimate contact with said first dielectric spacer, (3) a means for making an electrical contact with said first metal grid comprising a front electrode, c. a back section comprising:

(1) a second dielectric spacer having a grid pattern and an area that is less than the area of said center section and where said second dielectric spacer is in intimate contact with the non-metallized surface of said second metallized film, (2) a second metal grid having a multiplicity of perforations, and is sized to cover and be in intimate contact with said second dielectric spacer, (3) means for making an electrical contact with said second metal grid comprising a back electrode, d. a frame assembly having means for suspending said compound diaphragm, and B. a transducer driver unit having means for:

a. interfacing with said compound diaphragm, b. supplying a bias voltage to the center electrode, and c. providing an alternating signal, analogous to an audio signal, across said front and back electrodes to allow said compound diaphragm to be driven in a push-pull relation.

7. An electrolytic loudspeaker assembly comprising:

A. A capacitive transducer having a compound diaphragm, where said compound diaphragm comprises:

a. a center section having an area comprising:

(1) a first metallized film is heat shrinkable and has a metallized surface that faces inwardly and a non-metallized surface that faces outwardly, (2) a thin layer of petroleum gel spread evenly over the metallized surface of said first metallized film, (3) a second metallized film also being heat shrinkable and having a metallized surface that faces inwardly and a non-metallized surface that faces outwardly where the metallized surface of said second metallized film is sized to cover and be in intimate contact with said thin layer of petroleum gel covering said first metallized film, (4) a center electrode extending downward from said center section, b. a front section comprising:

(1) a first dielectric spacer having a thickness between 0.001 to 0.009 inches (0.025 to 0.229 mm), a grid pattern having a plurality of thin angular sections interposed within a perimeter border section, an area that is less than 75 percent of the area of said center section and where said first dielectric spacer is in intimate contact with the non-metallized surface of said first metallized film, (2) a first metal grid having a multiplicity of perforations consisting of first bores and larger second bores and sized to cover and be in intimate contact with said first dielectric spacer, (3) a front electrode extending downward from said first metal grid, c. a back section comprising:

(1) a second dielectric spacer having a similar thickness, grid pattern and area as of said first dielectric spacer and that is in intimate contact with the non-metallized surface of said second metallized film, (2) a second metal grid having a multiplicity of perforations similar to those of said first metal grid and is sized to cover and be in intimate contact with said second dielectric spacer, (3) a back electrode extending downward from said second metal grid, d. a frame assembly comprising (1) a front section having an inward side to which is attached edges of the non-metallized surface of said first metallized film, where after attachment heat is applied to said first metallized film to allow said first metallized film to shrink and be stretched taut, (2) a back section having an inward side to which is attached edges of the non-metallized surface of said second metallized film which is also heat shrunk to provide a taut fit and where the two inward sides of the frame sections are brought together in alignment and attached by an attachment means to thus form said compound diaphragm, B. a transducer driver unit having the means for:

a. interfacing with said compound diaphragm, b. supplying an unregulated, d-c bias voltage to the center electrode, and c. providing an alternating signal, analogous to an audio signal, across said front and back electrodes to allow said compound diaphragm to be driven in a push-pull relation.

* * * * *